US008684193B1

(12) United States Patent
Sharon

(10) Patent No.: US 8,684,193 B1
(45) Date of Patent: Apr. 1, 2014

(54) FOLDABLE HANGING CONTAINER SYSTEM AND METHOD OF FORMING

(76) Inventor: Arie Sharon, Richardson, TX (US)

( * ) Notice: Subject to any disclaimer, the term of this patent is extended or adjusted under 35 U.S.C. 154(b) by 133 days.

(21) Appl. No.: 13/332,362

(22) Filed: Dec. 20, 2011

Related U.S. Application Data

(60) Provisional application No. 61/459,823, filed on Dec. 20, 2010.

(51) Int. Cl.
*A47G 29/00* (2006.01)
*A47F 5/08* (2006.01)
*B65D 25/24* (2006.01)

(52) U.S. Cl.
USPC ..... 211/73; 211/94.01; 220/480

(58) Field of Classification Search
USPC ..... 211/72, 73, 94.01, 49.1, 11, 193, 87.01; 206/526, 736, 774; 220/480, 481, 62; 248/459, 174, 150
See application file for complete search history.

(56) References Cited

U.S. PATENT DOCUMENTS

| | | | | | |
|---|---|---|---|---|---|
| 2,023,542 | A * | 12/1935 | Peck | 221/45 |
| 2,770,513 | A * | 11/1956 | Brown | 220/482 |
| 3,397,832 | A * | 8/1968 | Thiele | 206/526 |
| 3,907,104 | A * | 9/1975 | Taub | 206/45.23 |
| 4,058,206 | A * | 11/1977 | Morse et al. | 229/241 |
| 4,228,904 | A * | 10/1980 | Dumond | 211/55 |
| 4,437,569 | A * | 3/1984 | Sorenson | 229/204 |
| 4,574,945 | A * | 3/1986 | Giblin | 229/112 |
| 4,687,094 | A * | 8/1987 | Allsop et al. | 206/774 |
| 4,928,849 | A * | 5/1990 | Khozai | 221/45 |
| 5,193,740 | A * | 3/1993 | Newborough et al. | 229/242 |
| 5,224,610 | A * | 7/1993 | Veazey | 211/87.01 |
| 5,322,167 | A * | 6/1994 | Birutis et al. | 211/50 |
| 5,505,309 | A * | 4/1996 | Taravella et al. | 206/485 |
| 5,752,597 | A * | 5/1998 | Brangle, Jr. | 206/45.21 |
| 5,819,939 | A * | 10/1998 | Boyer | 206/461 |
| 6,435,351 | B1 * | 8/2002 | Gibb | 206/736 |
| 6,454,107 | B1 * | 9/2002 | Belanger et al. | 211/59.3 |
| 6,554,135 | B1 * | 4/2003 | Luceri et al. | 206/526 |
| 6,755,306 | B2 * | 6/2004 | Maus | 206/774 |
| 7,044,300 | B2 * | 5/2006 | Tamai | 206/395 |
| 7,255,232 | B2 * | 8/2007 | Kakuda | 206/526 |
| 7,284,662 | B2 * | 10/2007 | DeBusk et al. | 206/745 |
| 7,410,062 | B2 * | 8/2008 | Monk | 206/774 |
| 7,478,745 | B2 * | 1/2009 | Philips | 229/240 |
| 7,621,393 | B2 * | 11/2009 | Kim | 206/278 |
| 7,717,324 | B2 * | 5/2010 | Keefe, Jr. | 229/240 |
| 7,735,649 | B2 * | 6/2010 | Kim-Gifford et al. | 206/485 |
| 7,967,154 | B1 * | 6/2011 | Sharon | 211/126.16 |
| 7,992,716 | B2 * | 8/2011 | Jackson | 206/738 |
| 8,281,927 | B2 * | 10/2012 | Smith | 206/485 |
| 2004/0084350 | A1 * | 5/2004 | Kim | 206/736 |
| 2004/0163994 | A1 * | 8/2004 | Gardner et al. | 206/736 |
| 2006/0010560 | A1 * | 1/2006 | Kim | 2/144 |
| 2008/0197182 | A1 * | 8/2008 | Jackson | 229/247 |
| 2009/0084706 | A1 * | 4/2009 | Keefe, Jr. | 206/736 |
| 2009/0159488 | A1 * | 6/2009 | Grant et al. | 206/736 |
| 2011/0036749 | A1 * | 2/2011 | Jacobsson et al. | 206/736 |

* cited by examiner

*Primary Examiner* — Darnell Jayne
*Assistant Examiner* — Kimberley S Wright
(74) *Attorney, Agent, or Firm* — Kenneth A. Roddy

(57) ABSTRACT

A foldable container or holder that is foldable from a first flat planar shipping and storing configuration to a second erected generally rectangular configuration having an open top end for storing or holding items. The container or holder is formed from a flat planar blank of stiff material which is die cut, scored and slotted in a pattern which, when folded, forms a generally rectangular container or holder with a suspending tab for hanging or suspending the container r holder on a horizontal support track.

2 Claims, 5 Drawing Sheets

FOLDABLE HANGING CONTAINER SYSTEM AND METHOD OF FORMING

CROSS REFERENCE TO RELATED APPLICATION

This application claims priority of U.S. Provisional Patent Application Ser. No. 61/459,823, filed on Dec. 20, 2010.

BACKGROUND OF THE INVENTION

1. Field of the Invention

This invention generally relates generally to containers and holders such as magazine and file holders and the like, and, more particularly to a foldable container or holder formed of a one-piece blank of stiff material which is scored and cut in a pattern which, when folded, forms a generally rectangular container or holder with a suspending tab for hanging or suspending the container on a support member, and to the method of forming the container.

2. Background Art

Containers and holders which can be suspended from a support member are known in the art. For example, U.S. Pat. No. 7,967,154, issued to Arie Sharon, one of the co-inventors of the present invention, and which is incorporated herein by reference, discloses a display support system for releasably supporting a plurality of product-containing containers for display and sales of the products contained therein. The system includes a generally rectangular container having an open top end, a bottom end wall, and vertical side walls. In one embodiment, the containers are supported on a horizontal support channel having an inverted generally U-shaped longitudinally extending top portion defining a lip, and a longitudinally extending L-shaped flange at the bottom, wherein the top end of the rear wall of the container is engaged under the depending lip and its bottom corner is supported on the protruding flange of the channel.

Rigid and stiff pre-formed containers and holders which can be suspended from a support member are also known in the art. For example, U.S. Pat. No. 3,069,019, discloses a merchandise rack for supporting a number of readily available conventional pans or plastic or fiber containers of various widths and shapes. The device comprises a vertically extending and horizontally elongated plate having an inverted generally L-shaped flange at an upper end defining a depending lip having a series of longitudinally spaced notches defining spaced apart depending lip portions, and an outwardly and downwardly inclined flange at a lower end, whereby a series of elongated article receiving pans are removably mounted thereon. Each pan has vertical side walls, an open top end, and a bottom wall. The bottom wall is supported on the lower flange and the upper edge of one side wall fits into the space defined between the lip portions at the upper end and the adjacent opposed edges of the pan extend through the notches.

Preformed and foldable magazine holders formed of paperboard or plastic materials also known in the art, but are not designed to be suspended and are incapable of being folded to create a hook-shaped suspending tab for hanging or suspending them from a support member. For example, European Patent Application EP 0099170 (which was subsequently withdrawn) discloses a foldable magazine holder formed from a single sheet of plastic having folding flanges and coupling slots, and tabs which can be releasably engaged into locking interrelationship assume a three-dimensional structure when erected.

SUMMARY OF THE INVENTION

The present invention is distinguished over the prior art in general, and these patents in particular by a foldable container or holder that is foldable from a first flat planar shipping and storing configuration to a second erected generally rectangular configuration having an open top end for storing or holding items. The container or holder is formed from a flat planar blank of stiff material which is die cut, scored and slotted in a pattern to define a back wall portion, a first flap portion at a bottom end of the back wall portion, a first side wall portion at one side of the back wall portion, a first front wall portion at an outer side of the first side wall portion, a second side wall portion at an opposed side of the back wall portion, a second side wall portion at an opposed side of the back wall portion, a second front wall portion at an outer side of the second front wall portion, a second flap portion at a bottom end of the second front wall portion, a first bottom wall portion at a bottom end of the first side wall portion, and a second bottom wall portion at a bottom end of the second side wall portion. The lateral sides of the first flap portion, the second flap portion, the first bottom wall portion and the second bottom wall portion are separated by vertical slots therebetween. The second front wall portion and the second bottom wall portion are provided with strips of double-sided adhesive with a removable cover.

The flat planar blank in the second erected generally rectangular configuration is folded such that the first sidewall portion and the second side wall portion extend perpendicular to the back wall portion in laterally spaced generally parallel relation, the first front wall portion and the second end wall extend perpendicular to the first an second side wall portions in overlapped relation, and are secured together by the adhesive strip on the second front wall portion.

The first flap portion and the second flap portion are disposed perpendicular to the back wall portion and the first front wall portion, respectively, the first bottom wall portion extends perpendicular to the first side wall portion in overlapped relation to the first and second flap portions, and the second bottom wall portion extends perpendicular to the second side wall portion in overlapped relation over the first bottom wall portion, and are secured together by the adhesive strips of the second bottom wall portion.

The blank also has a wide generally rectangular U-shaped opening die cut through the blank a distance below the top end of the back wall portion, the opening having a horizontal bottom, laterally opposed outer vertical sides, laterally opposed top ends extending inward a short distance from the outer vertical sides, short laterally opposed inner sides extending downwardly therefrom spaced a short distance from the outer sides, and a horizontal top adjoining the bottom ends thereof. In the second erected folded generally rectangular configuration with the first and second side wall portions folded generally perpendicular to the back wall portion, the outer sides of the generally rectangular U-shaped opening move with the first and second side wall portions to define a generally rectangular suspending tab and a horizontal lower lip at a bottom of the suspending tab. The suspending tab is adapted to be received in an elongate horizontally disposed track having a generally U-shaped longitudinally extending channel with an upstanding lip, and the lower lip at said bottom end of the suspending tab is received in the track channel and retained by the lower lip of the track channel.

DESCRIPTION OF THE PREFERRED EMBODIMENT

Referring now to FIGS. 1, 2, 3 and 4, the containers or holders 10 in accordance with the present invention are each constructed from of a one-piece flat planar sheet or blank 11 (FIG. 1) formed of a stiff foldable material, such as corrugated paperboard, cardboard, plastic, or other suitable stiff material which is die cut, slotted, and scored, and then folded into to a generally rectangular three-dimensional shape. As used herein, the terms "scored" and "score lines" are defined as a line forced or impressed into the material to form a hinge between two adjacent portions of the material.

Figure 1:
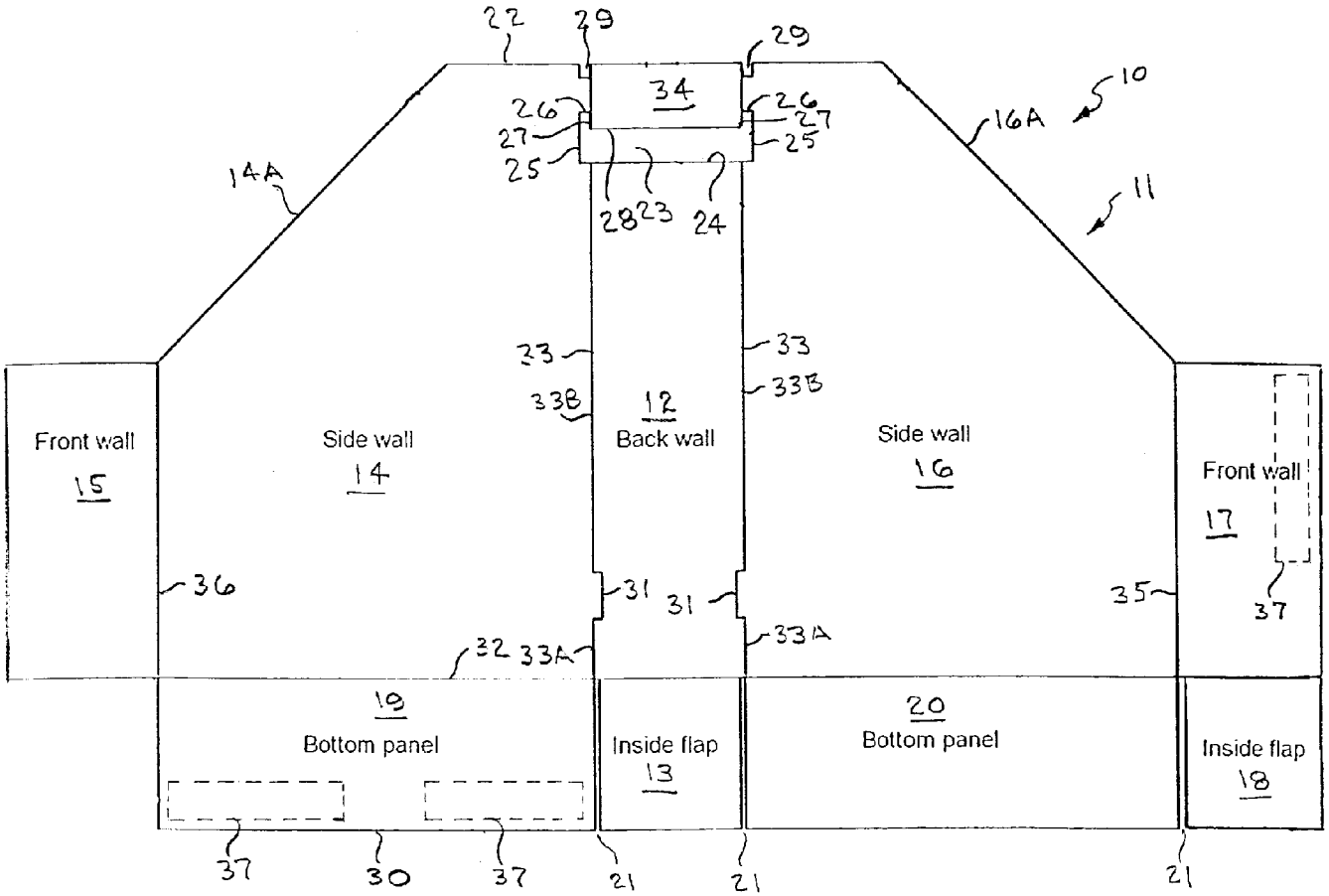
FIG. 1 is a plan view of the blank of stiff foldable material that is used to the form the container or holder in accordance with the present invention.

In the exemplary blank 11 shown in FIG. 1, the blank is die cut, scored and slotted in a pattern to define a back wall portion 12, a first inside flap portion 13 at a bottom end of the back wall portion, a first side wall portion 14 at one side of the back wall portion, a first front wall portion 15 at an outer side of the first side wall portion, a second side wall portion 16 at an opposed side of the back wall portion, a second front wall portion 17 at an outer side of said second front wall portion, a second inside flap portion 18 at a bottom end of said second front wall portion, a first bottom wall portion 19 at a bottom end of said first side wall portion, and a second bottom wall portion 20 at a bottom end of the second side wall portion. The adjacent sides of the first flap portion 13, the second flap portion 18, the first bottom wall portion 19 and the second bottom wall portion 20 are separated by vertical slots 21 therebetween. In the example of FIG. 1, the upper portion 14A and 16A of the first and second side wall portions 14 and 16 extend angularly downward from the top end 22 of the blank, and the first and second front wall portions 15 and 17 extend laterally outward and downward from the angular side wall portions.

A wide generally rectangular U-shaped opening 23 is die cut through the blank a distance below the top end 22. The die cut opening 23 has a horizontal bottom 24, laterally opposed outer vertical sides 25, laterally opposed top ends 26 that extend inward a short distance from the outer vertical sides 25, short laterally opposed inner sides 27 that extend downwardly therefrom spaced a short distance from the outer sides, and a horizontal top 28 that adjoins the bottom ends thereof. The top end of the blank 11 has a pair of die cut laterally opposed generally rectangular slots 29 that are disposed above and in axial alignment with the opening formed between the outer vertical sides 25 and short laterally opposed inner sides 27 of the opening 23, respectively.

The bottom portion of the blank 11 has a pair of central parallel laterally spaced die cut vertical slots 21 that extend upwardly a distance from the bottom end 30, and an outer die cut vertical slot 21 spaced a distance inwardly from the lower side portion that extends upwardly a distance from the bottom end 30 of the blank 11 in parallel relation to the central vertical slots 21 and terminates at the same height thereof. A pair of laterally opposed generally square C-shaped die cuts 31 are disposed a distance above the central laterally spaced vertical slots 21.

An elongate score line 32 extends horizontally across the blank 11 between its outer sides parallel with its bottom end 30 and intersects the top ends of the laterally spaced vertical slots 21. The horizontal score line 31 forms a hinge between the vertical slots 21, the first and second bottom portions 19 and 20 at each side thereof, and the second inside flap 18 disposed at one side of the second bottom portion 20.

A pair of parallel laterally spaced vertical score lines 33 extend upwardly a distance from the central laterally spaced vertical slots 21 and form a hinge along the back wall 12 that extends between the first inside flap 13 and the top end 22 of the blank 11 and the first and second side wall portions 14 and 16 at each side thereof. The vertical score lines 33 have lower portions 33A that extend upwardly from the central laterally spaced vertical slots 21 and terminate at the lower outer sides of the generally square C-shaped cuts 31, and upper portions 33B that extend upwardly from the upper outer sides of the generally square C-shaped cuts 31, and across the die cut opening 23 generally coaxial with the short laterally opposed inner sides 27 thereof and the inner sides of the generally rectangular slots 29 at the top end of the blank 11. The upper portions 33B of the score lines 33 above the die cut opening 23 define a generally rectangular suspending tab 34 at the upper end of the back wall portion 12.

A third vertical score line 35 extends upwardly a distance from the outer vertical slot 21 and forms a hinge between the second front wall 17 at the outer side of the second side wall portion 17, and a fourth vertical score line 36 extends upwardly a distance from the outer side of the first bottom wall portion 19 to form a hinge between the first front wall portion 14 and the first front wall portion 15.

As shown in dashed line, suitable fasteners 37, such as strips of double sided adhesive tape with a removable peel-off outer cover sheet are secured to the first bottom portion 19 and the second front wall portion 17.

Figure 3:
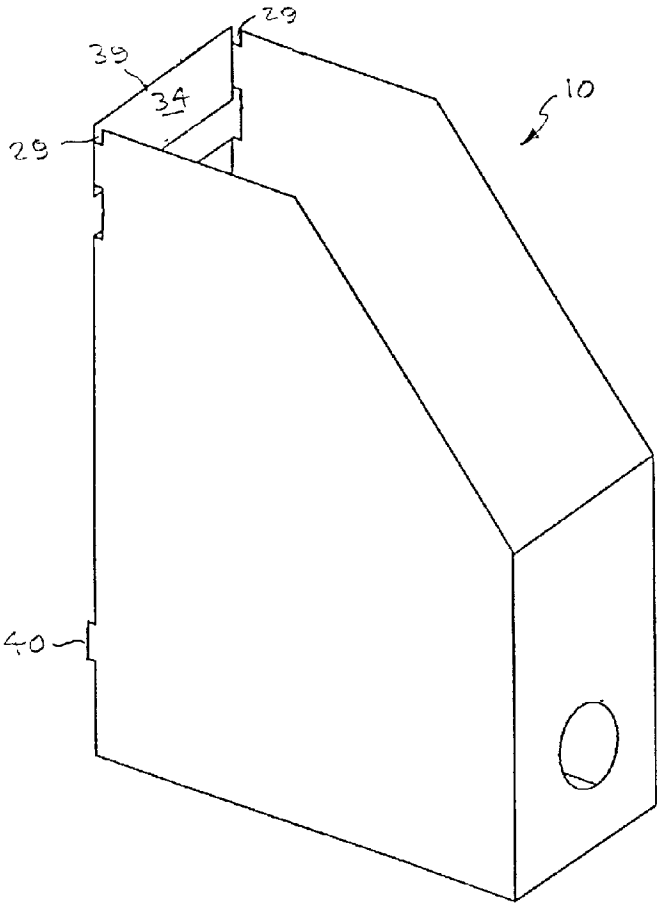
FIGS. 2 and 3 are perspective views of a first embodiment of a container or holder formed from the blank, as seen from the back side and front side, respectively.
Figure 2:
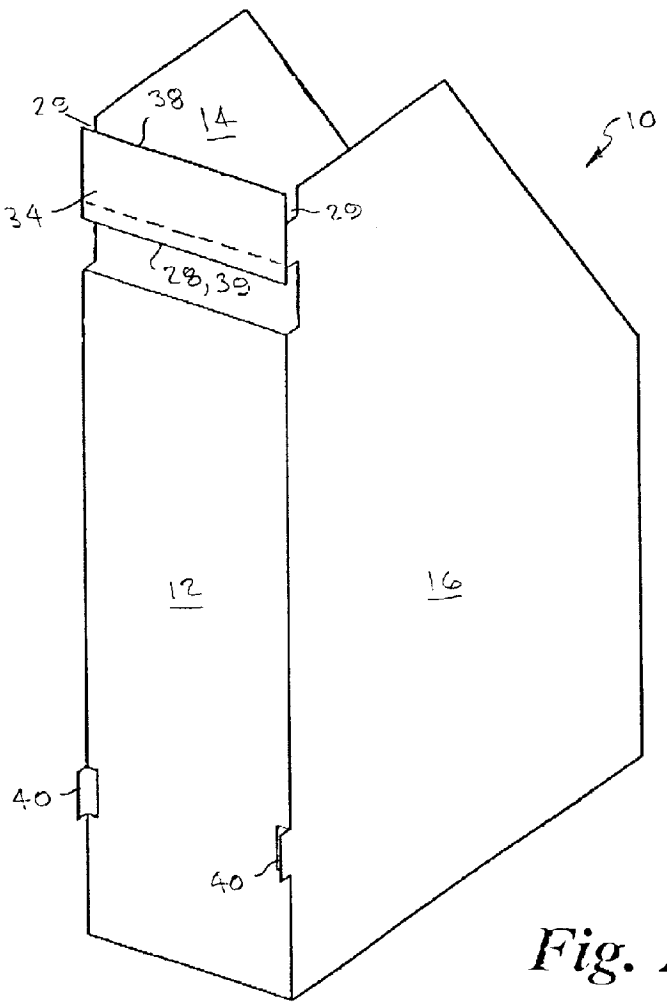

To erect the container or holder as shown in FIGS. 2 and 3, the first and second side wall portions 14 and 16 at each side of the central parallel laterally spaced vertical score lines 33 are folded generally perpendicular to the back wall portion 12, and the first front wall portion 15 is folded generally perpendicular to the first side wall portion 14 to be generally parallel with the back wall portion. The cover sheet of the adhesive tape strip 37 on the second front wall portion 17 is peeled off and the second front wall portion is folded over and adhered to the outer surface of the first front wall portion 15, forming a generally rectangular configuration. The first and second inside flaps 13 and 18 are folded upwardly to into the rectangular configuration to reside generally horizontally, and the second bottom portion 20 is folded into the rectangular configuration to reside generally perpendicular to the second side wall portion 16 and to reside generally horizontally beneath the first and second inside flaps 13 and 18. The cover sheet of the adhesive tape strip 17 on the first bottom portion 19 is peeled off and the first bottom portion is folded over and adhered to the outer facing surface of the second bottom wall portion 20 to form the bottom of the container or holder 10.

Figure 4:
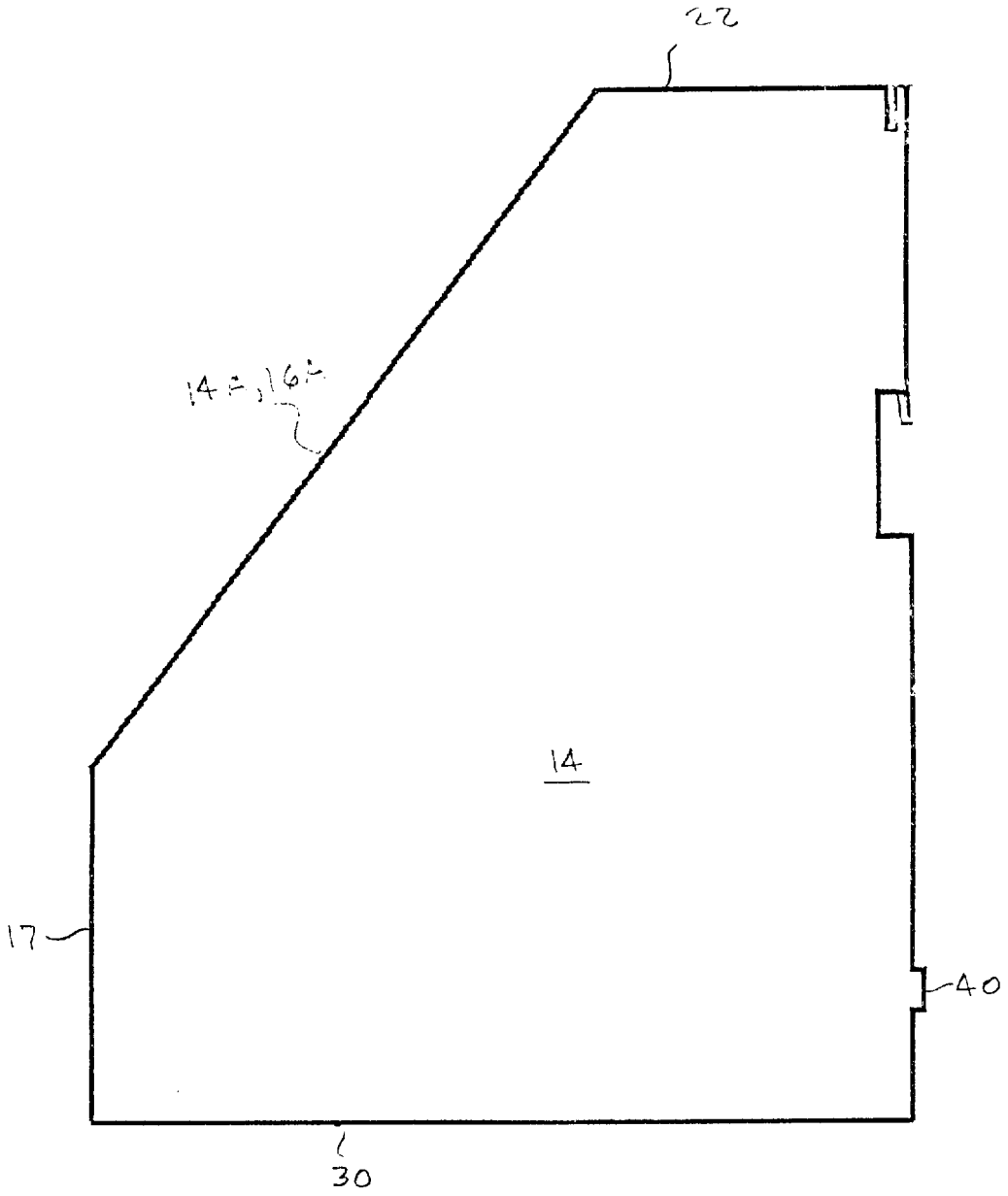
FIG. 4 is a side elevation view of the container or holder of FIGS. 2 and 3.

Referring additionally to FIG. 4, when the first and second side wall portions 14 and 16 at each side of the central parallel laterally spaced vertical score lines 33 are folded generally perpendicular to the back wall portion 12, the outer sides 27 of the generally rectangular die cut opening 23 and the generally rectangular slots 29 move with the first and second side wall portions to define a horizontal upper lip 38 at the top of the generally rectangular suspending tab 34 and a lower horizontal lip 39 at the bottom of the suspending tab.

Also, when the first and second side wall portions 14 and 16 at each side of the central parallel laterally spaced vertical score lines 33 are folded generally perpendicular to the back wall portion 12, the generally the generally square C-shaped cuts 31 form generally rectangular tabs 40 that protrude a short distance outwardly from the laterally opposed longitudinal corners of the back wall portion 12.

Figure 5:
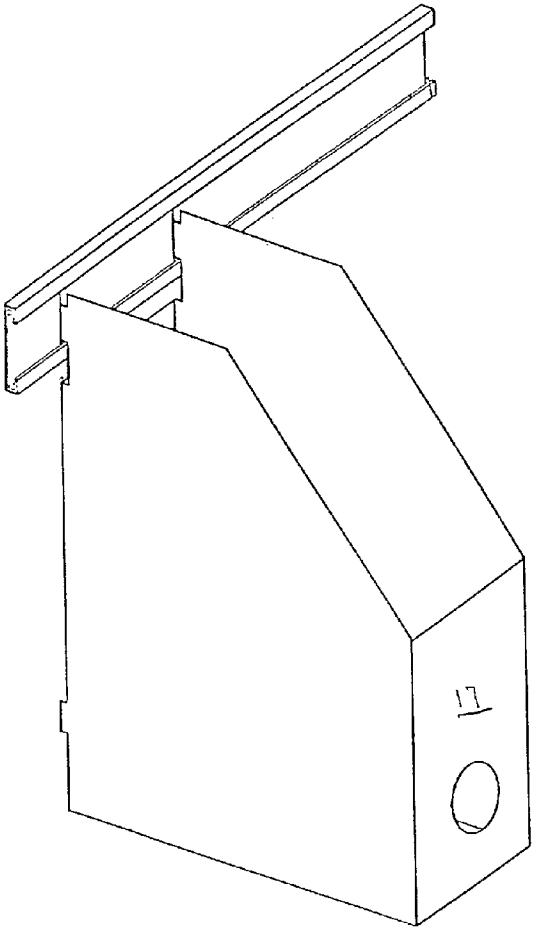
FIG. 5 is a perspective view of the container or holder of FIGS. 2 and 3 shown suspended from an elongate horizontally supported track.

Referring additionally to FIG. 5, the container or holder 10 of the embodiment of FIGS. 2 and 3 is shown suspended from an elongate horizontally supported extruded track 41 which is attached to a vertical surface, such as a wall or other flat vertical surface. The top of the track 41 has an inverted generally U-shaped longitudinally extending top portion that is bent over and a short distance vertically downward to form a upper channel 42 with an upper lip 43 and a generally U-shaped longitudinally extending bottom portion that is bent over and a sort distance vertically upward to define a lower channel 44 with an upstanding lower lip 45. The generally rectangular suspending tab 34 is slidably received in the track 41 such that the horizontal upper lip 38 and lower lip 39 at the top and bottom of the suspending tab are received in the upper and lower channels 42 and 44 and retained by the upper and lower lips 43 and 45 of the channels. The generally rectangular tabs 40 protruding a short distance outwardly from the back wall portion 12 engage the wall or other flat vertical surface to maintain the container or holder 10 in a vertical orientation. It should be understood that a plurality of the containers or holders may be suspended from the track, and different sizes of the container or holders can be suspended in different locations, on the same track, and can be slidably moved from side to side.

Figure 6:
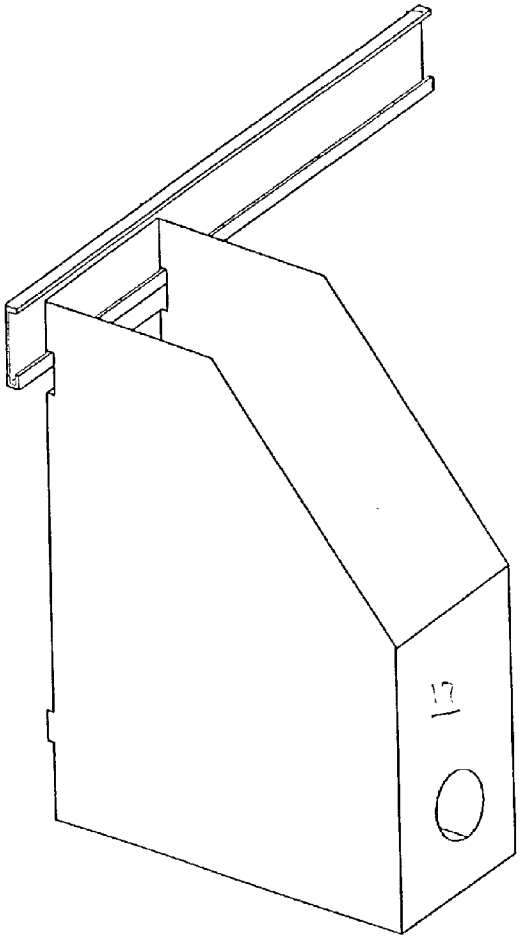
FIG. 6 is a perspective view, similar to FIG. 5, showing a modification of the container or holder wherein the top end of the suspending tab is in the same plane as the top end of the side wall portions.

FIG. 6 shows a modification of the container or holder 10A wherein the pair of die cut laterally opposed generally rectangular slots defining the horizontal upper lip of the rectangular suspending tab 34 are eliminated, and thus the top end of the suspending tab is in the same plane as the top end of the side wall portions 14 and 16. The other features of the container or holder 10A are the same as described previously and are assigned the same numerals of reference, but will not be described again in detail to avoid repetition. In this modification, the container or holder 10A may be suspended from an elongate horizontally supported extruded track 41A attached to a vertical surface, such as a wall or other flat vertical surface wherein the top of the track 41A is bent over to form an inverted L-shaped flange or lip 43A that protrudes horizontally outward and extends longitudinally, and a generally U-shaped longitudinally extending bottom portion that is bent over and a sort distance vertically upward to define a lower channel 44 with an upstanding lower lip 45. The generally rectangular suspending tab 34 can be inserted forwardly into the track 41A with its top end guided by the lip 43A and then lowered downwardly such that the horizontal lower lip 39 at the bottom of the suspending tab 34 is received in the lower channel 44 and retained by the lower lip 45 of the track channel. The generally rectangular tabs 40 protruding a short distance outwardly from the back wall portion 12 engage the wall or other flat vertical surface to maintain the container or holder 10A in a vertical orientation. It should be understood that a plurality of the containers or holders may be suspended from the track, and different sizes of the container or holders can be suspended in different locations, on the same track, and can be slidably moved from side to side.

Figure 7:
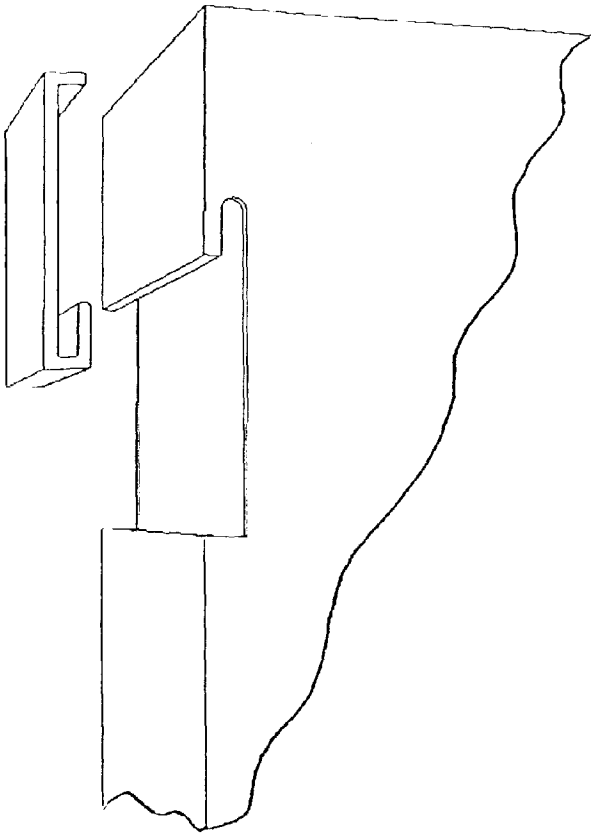
FIG. 7 is a partial perspective view, similar to FIG. 6, of another modification of the container or holder wherein the laterally opposed top ends of the die cut opening are curved to provide a curved top surface forwardly of the horizontal lower lip at the bottom of the suspending tab.

FIG. 7 shows another modification of the container or holder 10B wherein the laterally opposed top ends 26 of the wide die cut opening 23 are curved between the outer vertical sides 25 and short laterally opposed inner sides 27, which when folded forms a curved top surface 26A forwardly of the horizontal lower lip 39 at the bottom of the suspending tab 34. As with the previous embodiment, the horizontal lower lip 39 at the bottom of the suspending tab 34 is received in the lower channel 44 of the track 41A and retained by the lower lip 45 of the track channel.

Figure 8:
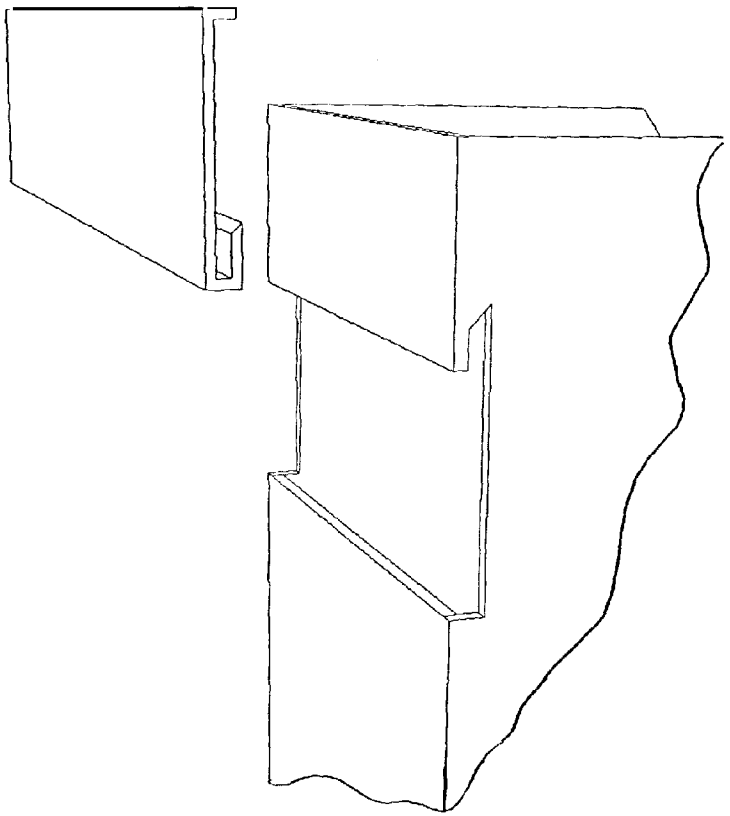
FIG. 8 is a partial perspective view, similar to FIG. 6, of another modification of the container or holder wherein the laterally opposed top ends of the wide die cut opening are cut at an angle to form a tapered top surface that extends upwardly from the horizontal lower lip at the bottom of the suspending tab.

FIG. 8 shows another modification of the container or holder 10C wherein the laterally opposed top ends 26 of the wide die cut opening 23 are cut at an angle, and when folded forms a tapered top surface 26B that extends upwardly from the horizontal lower lip 39 at the bottom of the suspending tab 34 In this modification, the top surface of the upstanding lower lip 45 of the lower channel 44 of the track 41A may also be angled to engage the angled top surface 26Bx. As with the previous embodiments, the horizontal lower lip xx at the bottom of the suspending tab xx is received in the lower channel xx of the track xx and retained by the lower lip xx of the track channel.

It should be understood that the examples of the present container or holder are shown, for purposes of example only, as having an upright rear wall, a front wall of reduced height compared to the rear wall, and a pair of laterally spaced side walls having an angled upper portion interconnecting the end walls which form a slanted or cut corner along the front, upper edge in the form of a holder suitable for storing magazines, books, and the like. It should be understood that the laterally opposed side walls may be straight rather than having an angular upper portion, such that front wall is of the same height as the rear wall, so as to form a generally rectangular container for storing a wide variety of articles.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A foldable container or holder foldable from a first flat planar shipping and storing configuration to a second erected generally rectangular configuration having an open top end for storing or holding items, comprising:

a flat planar blank formed of stiff material die cut, scored and slotted in a pattern to define a back wall portion, a first flap portion at a bottom end of said back wall portion, a first side wall portion at one side of said back wall portion, a first front wall portion at an outer side of said first side wall portion, a second side wall portion at an opposed side of said back wall portion, a second front wall portion at an outer side of said second side wall portion, a second flap portion at a bottom end of said second front wall portion, a first bottom wall portion at a bottom end of said first side wall portion, and a second bottom wall portion at a bottom end of said second side wall portion;

lateral sides of said first flap portion, said second flap portion, said first bottom wall portion and said second bottom wall portion being separated by vertical slots therebetween;

fastener means on said second front wall portion and said second bottom wall portion;

a wide generally rectangular U-shaped opening cut through said blank a distance below a top end of said back wall portion, said opening having a horizontal bottom, laterally opposed outer vertical sides, laterally opposed top ends extending inward a short distance from said outer vertical sides, short laterally opposed inner sides extending downwardly therefrom spaced a short distance from said outer sides, and a horizontal top adjoining the bottom ends thereof;

said flat planar blank in said second erected generally rectangular configuration being folded such that said first side wall portion and said second side wall portion extend perpendicular to said back wall portion in laterally spaced generally parallel relation, said first front wall portion and said second front wall portion extend perpendicular to said first and second side wall portions in overlapped relation, and are secured together by said fastener means on said second front wall portion; and said first flap portion and said second flap portion are disposed perpendicular to said back wall portion and said first front wall portion, respectively, said first bottom wall portion extends perpendicular to said first side wall portion in overlapped relation to said first and second flap portions, and said second bottom wall portion extends perpendicular to said second side wall portion in overlapped relation over said first bottom wall portion, and are secured together by said fastener means on said second bottom wall portion; and in said second erected folded generally rectangular configuration when said first and said second side wall portions are folded generally perpendicular to said back wall portion, said outer sides of said generally rectangular U-shaped opening move with said first and said second side wall portions to define a generally rectangular suspending tab and a horizontal lower lip at a bottom of said suspending tab;

said suspending tab adapted to be received in an elongate horizontally disposed track having a generally U-shaped longitudinally extending channel with an upstanding lower lip, and said lower lip at said bottom end of said suspending tab received in the track channel and retained by the lower lip of the track channel.

2. A method of forming a foldable container or holder, comprising the steps of:

providing a flat planar blank formed of stiff material die cut, scored and slotted in a pattern to define a back wall portion, a first flap portion at a bottom end of said back wall portion, a first side wall portion at one side of said back wall portion, a first front wall portion at an outer side of said first side wall portion, a second side wall portion at an opposed side of said back wall portion, a second front wall portion at an outer side of said second side wall portion, a second flap front wall portion, a second flap portion at a bottom end of said second front wall portion, a first bottom wall portion at a bottom end of said first side wall portion, and a second bottom wall portion at a bottom end of said second side wall portion;

lateral sides of said first flap portion, said second flap portion, said first bottom wall portion and said second bottom wall portion being separated by vertical slots therebetween;

fastener means on said second front wall portion and said second bottom wall portion;

a wide generally rectangular U-shaped opening cut through said blank a distance below a top end of said back wall portion, said opening having a horizontal bottom, laterally opposed outer vertical sides, laterally opposed top ends extending inward a short distance from said outer vertical sides, short laterally opposed inner sides extending downwardly therefrom spaced a short distance from said outer sides, and a horizontal top adjoining the bottom ends thereof;

folding said flat planar blank such that said first side wall portion and said second side wall portion extend perpendicular to said back wall portion in laterally spaced generally parallel relation, and said first front wall portion and said second front wall portion extend perpendicular to said first and second side wall portions in overlapped relation, and securing said overlapped first and second side wall portions together with said fastener means of said second front wall portion;

when said first and said second side wall portions are folded generally perpendicular to said back wall portion, said outer sides of said generally rectangular U-shaped opening move with said first and said second side wall portions to define a generally rectangular suspending tab and a horizontal lower lip at a bottom of said suspending tab;

folding said flat planar blank such that said first flap portion and said second flap portion are disposed perpendicular to said back wall portion and said first front wall portion, respectively, and said first bottom wall portion extends perpendicular to said first side wall portion in overlapped relation to said first and second flap portions, and said second bottom wall portion extends perpendicular to said second side wall portion in overlapped relation over said first bottom wall portion, and securing overlapped said second bottom wall portion and said first bottom wall portion together by said fastener means of said second bottom wall portion to form a generally rectangular container or holder having an open top end for storing or holding items and a suspending tab on said back wall portion for hanging or suspending said container or holder on a horizontal support track.

* * * * *